US009587295B2

(12) United States Patent
Chai et al.

(10) Patent No.: US 9,587,295 B2
(45) Date of Patent: Mar. 7, 2017

(54) AUSTENITIC ALLOY

(71) Applicant: SANDVIK INTELLECTUAL PROPERTY AB, Sandviken (SE)

(72) Inventors: Guocai Chai, Sandviken (SE); Jan Hogberg, Gavle (SE); Sofia Akesson, Sandviken (SE); Urban Forsberg, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 0 days.

(21) Appl. No.: 14/372,760

(22) PCT Filed: Jan. 16, 2013

(86) PCT No.: PCT/EP2013/050723
§ 371 (c)(1),
(2) Date: Jul. 17, 2014

(87) PCT Pub. No.: WO2013/107763
PCT Pub. Date: Jul. 25, 2013

(65) Prior Publication Data

US 2014/0348699 A1 Nov. 27, 2014

(30) Foreign Application Priority Data

Jan. 18, 2012 (EP) ..... 12151566

(51) Int. Cl.
*C22C 30/02* (2006.01)
*C22C 38/42* (2006.01)
(Continued)

(52) U.S. Cl.
CPC ..... *C22C 30/02* (2013.01); *C22C 38/42* (2013.01); *C22C 38/44* (2013.01); *C22C 38/58* (2013.01); *C21D 2211/001* (2013.01)

(58) Field of Classification Search
CPC ..... C22C 38/44; C22C 38/58; C22C 38/42; C22C 38/001; C22C 30/02; C21D 2211/00
(Continued)

(56) References Cited

U.S. PATENT DOCUMENTS 4,824,638 A * 4/1989 Culling ..... 420/582
4,876,065 A 10/1989 Rockel et al.
(Continued)

FOREIGN PATENT DOCUMENTS

EP 2380998 A1 10/2011
JP 2003-534456 11/2003
(Continued)

OTHER PUBLICATIONS

J. Keiser et al. "Recovery Boiler Superheater Corrosion Field Study," Oak Ridge National Laboratory, NACE Corrosion 2010, Paper No. 10081, pp. 1-18 (2010).
(Continued)

*Primary Examiner* — Jie Yang
(74) *Attorney, Agent, or Firm* — Morgan, Lewis & Bockius LLP

(57) ABSTRACT

An austenitic alloy comprising (in weight %):
C: 0.01-0.05
Si: 0.05-0.80
Mn: 1.5-2
Cr: 26-34.5
Ni: 30-35
Mo: 3-4
Cu: 0.5-1.5
N: 0.05-0.15
V: <0.15
the balance being Fe and unavoidable impurities, wherein 40<% Ni+100*% N<50.

8 Claims, 3 Drawing Sheets

(51) Int. Cl.
*C22C 38/44* (2006.01)
*C22C 38/58* (2006.01)

(58) Field of Classification Search
USPC ..... 420/582
See application file for complete search history.

(56) References Cited

U.S. PATENT DOCUMENTS

| | | | | |
|---|---|---|---|---|
| 6,905,652 | B2 | 6/2005 | Ulfvin et al. | |
| 8,784,581 | B2 | 7/2014 | Igarashi et al. | |
| 2009/0291017 | A1 | 11/2009 | Otome et al. | |
| 2010/0313988 | A1* | 12/2010 | Matsuo | 138/177 |
| 2012/0276472 | A1* | 11/2012 | Ide et al. | 429/512 |
| 2014/0017111 | A1* | 1/2014 | Omura | F16L 9/02 420/40 |

FOREIGN PATENT DOCUMENTS

| | | |
|---|---|---|
| JP | 2005-023353 | 1/2005 |
| JP | 2005-509751 | 4/2005 |
| JP | 2009-084668 | 4/2009 |
| JP | 2009-167502 | 7/2009 |
| JP | 2010-163669 | 7/2010 |
| WO | WO 89/00209 | 1/1989 |
| WO | WO 01/90432 | 11/2001 |
| WO | 03044238 | 5/2003 |
| WO | 03044239 A1 | 5/2003 |
| WO | WO 2006/003953 | 12/2006 |

OTHER PUBLICATIONS

Notice of Reasons for Rejection (with English translation) for Japanese Application No. 2014-552606 dated Sep. 20, 2016.

* cited by examiner

| Alloy | Heat | C | Si | Mn | P | S | Cr | Ni | Mo | V | Cu | N | 40≤%Ni+100%N≤50 |
|---|---|---|---|---|---|---|---|---|---|---|---|---|---|
| 1 | 763554 | 0,015 | 0,18 | 1,75 | 0,011 | 0,003 | 27,01 | 31,01 | 3,51 | - | 1 | 0,039 | 34,91 |
| 2 | 462269 | 0,014 | 0,4 | 1,64 | 0,021 | 0,001 | 26,67 | 30,48 | 3,31 | 0,075 | 0,95 | 0,06 | 36,48 |
| 3 | 477353 | 0,009 | 0,49 | 1,71 | 0,020 | 0,001 | 26,89 | 30,81 | 3,46 | 0,083 | 0,97 | 0,049 | 35,71 |
| 4 | 469837 | 0,014 | 0,44 | 1,73 | 0,018 | 0,0003 | 27,11 | 33,21 | 3,44 | - | 0,95 | 0,11 | 44,21 |
| 5 | 471988 | 0,014 | 0,52 | 1,71 | 0,020 | <0,0005 | 27,25 | 33,36 | 3,42 | 0,088 | 0,96 | 0,093 | 42,66 |
| 6 | 469718 | 0,009 | 0,40 | 1,70 | 0,017 | 0,0006 | 27,29 | 33,45 | 3,43 | - | 0,98 | 0,096 | 43,05 |
| 7 | 477217 | 0,012 | 0,47 | 1,70 | 0,020 | 0,001 | 26,82 | 30,85 | 3,44 | 0,077 | 1 | 0,032 | 34,05 |
| 8 | 477203 | 0,010 | 0,38 | 1,78 | 0,021 | 0,001 | 26,85 | 30,98 | 3,47 | 0,14 | 1,06 | 0,037 | 34,68 |
| 9 | 460335 | 0,010 | 0,49 | 1,78 | 0,022 | 0,001 | 26,72 | 30,44 | 3,32 | 0,071 | 0,99 | 0,035 | 33,94 |
| 10 | 463024 | 0,013 | 0,08 | 1,72 | 0,015 | 0,003 | 26,88 | 30,87 | 3,52 | - | 1 | 0,047 | 35,57 |

Table 1: Chemical composition of alloys

Figure 1

AUSTENITIC ALLOY

RELATED APPLICATION DATA

This application is a §371 National Stage Application of PCT International Application No. PCT/EP2013/050723 filed Jan. 16, 2013 claiming priority of EP Application No. 12151566.2, filed Jan. 18, 2012.

TECHNICAL FIELD

The present invention relates to an austenitic alloy according to the preamble of claim 1. The invention also relates to a component for a combustion plant comprising the inventive austenitic alloy.

BACKGROUND

Power generation based on the combustion of biomass is regarded both sustainable and carbon neutral and is becoming an increasingly important source of energy.

A problem in biomass combustion is that the combustion products of the wide range of biomass fuels that are used are corrosive and may cause depositions on components in the biomass power plant. Especially exposed are superheaters, re-heaters and evaporators in biomass power plants, as well as in conventional steam boilers. A further problem in biomass power plants is that the materials in the components start to creep due to the high temperatures and the high pressures in the power plant. Today, biomass plants operate at a pressure of 150-200 bar and at a temperature of 500-550° C. In the future, biomass power plants temperatures are expected to be even higher than today, 600-650° C. This will put even higher demands on the hot corrosion resistance and the creep strength of the structural parts of the power plant.

Attempts have been made to increase corrosion resistance in steels. For example U.S. Pat. No. 4,876,065 and WO0190432 describe steels that are designed for use in corrosive environments in the oil- and gas industry.

Studies have further shown that austenitic stainless steel with high Mo content shows good resistance to high temperature corrosion: James R. Keisler, Oak ridge National laboratory, NACE Corrosion 2010, No 10081.

However, these steel do not exhibit the necessary creep strength to be suitable in biomass power plants.

Therefore, it is an object of the present invention to achieve an austenitic alloy which exhibits high corrosion resistance and high creep strength. It is also an object of the present invention to achieve a component for a steam boiler plant that comprises the inventive alloy.

SUMMARY OF THE INVENTION

According to the invention, this object is achieved by an austenitic alloy comprising (in weight %):

C: 0.01-0.05
Si: 0.05-0.80
Mn: 1.5-2
Cr: 26-34.5
Ni: 30-35
Mo: 3-4
Cu: 0.5-1.5
N: 0.05-0.15
V: ≤0.15 the balance Fe and unavoidable impurities, characterized in that 40≤% Ni+100*% N≤50

The inventive austenitic alloy has good resistance to high temperature corrosion, in particular good fire side corrosion. By balancing the additions of nickel and nitrogen in the alloy so that the condition 40≤% Ni+100*% N≤50 is fulfilled, a high creep strength and high ductility are further achieved in the alloy. The good resistance to high temperature corrosion in combination with high creep strength makes the inventive austenitic alloy very suitable as a material for structural parts in steam boilers. The inventive alloy is particularly useful in biomass power plants which operate under corrosive conditions at high temperatures and pressures.

Preferably, said austenitic alloy fulfils the requirement: 40≤% Ni+100*% N≤45. The alloy then exhibits very good creep strength and high ductility. This is advantageous when the material is used in steam boilers since it allows for high thermoplastic expansion and contraction of the material during start and shutdown of the boiler. Thus, the material can be subjected to cyclic heating and cooling without cracking.

Preferably the content of silica (Si) in the austenitic alloy is 0.3-0.55 wt %. Very high creep strength is thereby achieved in the alloy due to minimal formation of brittle sigma phase and minimal formation of oxygen containing inclusions.

Preferably, the content of carbon (C) in said austenitic alloy is 0.01-0.018 wt % in order to optimize the resistance to corrosion.

The invention also relates to a component for a combustion plant, preferably a biomass power plant or a biomass steam boiler that comprises the inventive austenitic alloy.

Said component may for example be a superheater or a reheater or an evaporator, preferably a tube of such a superheater, reheater or evaporator, and wherein the component is subjected to flue gases and elevated heat when in its operative position. The invention may thus, as an alternative, be defined as a combustion plant, preferably a biomass power plant, comprising a boiler, preferably a biomass steam boiler, comprising a component, preferably a superheater tube, a reheater tube or an evaporator tube, arranged in the boiler and subjected to flue gases and heat generated by said boiler during operation thereof, wherein said component comprises the alloy according to the invention.

DESCRIPTION OF THE INVENTION

The inventive austenitic alloy comprises the following alloy elements:

Carbon (C)

Carbon is an austenite stabilizing element and should therefore be included in the inventive alloy in an amount of at least 0.01 wt % Carbon is further important for increasing the creep strength of the material by the formation of carbonitrides. However, in the presence of chromium carbon forms chromium carbides which increases the risk of intergranular-corrosion. High carbon contents further reduces weldability. To minimize the formation of chromium carbides and to ensure good weldability the carbon content should not exceed 0.05 wt %. To inhibit the formation of chromium carbides even further, the content of carbon should preferably be in the range of 0.01-0.018 wt %.

Silicon (Si)

Silicon is used as a deoxidising element in the production of steel. However a high content of silicon is detrimental to weldability. In order to ensure low oxygen content in the steel and thereby few inclusions, the content of silicon should be at least 0.05 wt %. The content of silicon should however not exceed 0.80 wt % in order to ensure weldability of the steel. It has been found that when the content of silicon is in the range of 0.30-0.55 wt % very high creep strength is achieved in the inventive alloy. It is believed that the formation of sigma phase increases when the silicon level exceeds 0.55 wt %. The sigma phase reduces the ductility of the inventive alloy and therefore also the creep strength. Below 0.30 wt % the creep strength is reduced due to increased formation of oxygen-containing inclusions.

Manganese (Mn)

Manganese, like Si, is a deoxidising element, and it is also effective to improve the hot workability. The maximum content of manganese needs to be limited to control the ductility and toughness of the inventive alloy at room temperature. Therefore, the content of manganese should be in the range of 1.50-2.0 wt %.

Chromium (Cr)

Chromium is an effective element to improve the fire side corrosion resistance and steam oxidation resistance. In order to achieve a sufficient hot corrosion resistance for use as e.g. boiler tubes in biomass combustion power plants, a chromium content of at least 26% is needed. However, if the chromium is higher than 34.5%, the nickel content must be further increased since a higher Cr content can increase the risk of formation of intermetallic phases such as sigma phase. The chromium content should therefore be in the interval of 26.0 wt %-34.5 wt %. In the case of the present invention, very good material properties have been obtained with chromium contents in the range of 26.0-29.0 wt %, which is therefore to be regarded as a preferred range or at least an even more limited range within which the technical effect of the invention is achieved.

Nickel (Ni)

Nickel is an essential element for the purpose of ensuring a stable austenitic structure in the inventive alloy so that the formation of inter-metallic phases like sigma phase is suppressed. Sigma-phase is a hard and brittle intermetallic phase with chromium and molybdenum and is formed at elevated temperatures. Sigma phase has a negative impact of the ductility and elongation of the steel. By stabilizing the austenitic phase in the alloy, the formation of sigma phase is minimized. Nickel is therefore important for ensuring sufficient ductility and elongation of the steel. Nickel has also a positive effect on the corrosion resistance of the inventive alloy since it promotes the formation of a passive Cr-oxide film that suppresses further oxide growth, s c. scaling. The content of nickel should be at least 30 wt % in the inventive alloy in order to ensure structure stability, corrosion resistance and ductility. However, nickel is a relatively expensive alloy element and in order to maintain low production costs the content of nickel should be limited. Nickel further decreases the solubility of nitrogen in the alloy and therefore the content of nickel should not exceed 35 wt %.

Molybdenum (Mo)

Molybdenum is included in the inventive alloy in order to improve the hot corrosion resistance on the fire side of boiler tubes. Addition of Mo further improves the general-corrosion resistance of the inventive alloy. However, Mo is an expensive element and promotes precipitation of sigma-phase and thus invites deterioration of toughness of the steel. In order to ensure good hot corrosion resistance in the steel the content of molybdenum should be at least 3 wt %. The upper limit of molybdenum is 4 wt % to avoid precipitation of sigma phase.

Copper (Cu)

Addition of copper can improve both the creep strength by precipitation of copper rich phase, finely and uniformly precipitated in the matrix. However, an excessive amount of copper results in decreased workability. A high amount of copper can also lead to a decrease of ductility and toughness. Therefore the content of copper in the inventive alloy should be in the interval of 0.5-1.5 wt %. In the case of the present invention, particularly good results have been obtained with a copper content in the range of 0.8-1.2 wt %, which is therefore, at least for that reason, to be regarded as a preferred range or at least a more limited range within which the technical effect of the invention is achieved.

Nitrogen (N)

Nitrogen has a strong stabilizing effect on the austenitic structure and reduces therefore the formation of sigma-phase. This has a positive effect on the ductility of the steel. In the inventive alloy the main effect of nitrogen is that it, together with carbon, forms precipitations in the form of carbonitrides. The small carbonitride particles are generally precipitated at the grain boundaries of the steel and stop dislocations from propagating within the crystal grains of the steel. This greatly increases the creep resistance of the steel. The content of nitrogen should be at least 0.05 wt % in the inventive alloy in order to ensure a stable austenitic structure and that a sufficient amount of carbonitrides are formed. However, if nitrogen is present in high amounts large primary precipitations of nitrides could appear which reduce the ductility and toughness of the inventive alloy. Therefore, the content of nitrogen in the inventive alloy should be limited to 0.15 wt %.

Vanadium (V)

Addition of vanadium, titanium or niobium contributes to improve the creep rupture strength through the precipitation of MX phase. However, the excessive amount of vanadium can decrease the weldability and hot workability. Vanadium could therefore be allowed in the inventive alloy in an amount of ≤0.15 wt %.

Phosphorus (P) and Sulphur (S)

Phosphorus and sulphur are typically included as impurities in the raw materials for the inventive alloy and could cause weld cracking in high amounts. Therefore phosphorus should not exceed 0.035%. Sulphur should not exceed 0.005%.

Requirement: $40 \leq \%\ Ni + 100 * \%\ N \leq 50$

In the inventive alloy, the content of nickel and the content of nitrogen should be balanced to fulfil the requirement: $40 \leq \%\ Ni + 100 * \%\ N \leq 50$. It has shown that within this interval very good creep strength and ductility is achieved. It is believed that the good creep strength is the result of a synergistic effect from nickel and nitrogen. Preferably, the content of nickel and the content of nitrogen should be balanced to fulfil the requirement: $40 \leq \%\ Ni + 100 * \%\ N \leq 45$.

As stated above, nitrogen forms carbonitrides which promotes the creep strength by increasing the creep strain in the alloy. However, creep strength is affected negatively by any brittle phases, such as sigma phase. The addition of both nickel and nitrogen suppresses the formation of sigma-phase in the steel and increases thereby rupture elongation or the ductility of the alloy. This will reduce stress concentration and possible crack initiation and propagation. Consequently, this leads to an increase of the creep strength.

DESCRIPTION OF DRAWINGS

FIG. 1: A table over alloy compositions

EXAMPLE

Following the inventive alloy will be described with reference to a concrete example.

Ten steel heats were prepared by conventional steel making methods. The composition of respective steel heat is shown in table 1. The conventional metallurgical process according to which the heats were prepared was as follows: Melting by AOD method-hot rolling-extruding-cold pilgring (cold deformation)-solution annealing-water quenching. The hollow bar material after the hot extruding was then cold pilgred with a cold deformation between 40 to 80%, followed by a solution annealing at a temperature between 1050 to 1180° C. depending on the dimension. The following table shows the details.

| Alloy | Heat | Cold deformation (%) | Annealing | Cooling |
|---|---|---|---|---|
| 1 | 763554 | 40-80 | 1050-1180° C./5-25 minutes | water quenching |
| 2 | 462269 | 40-80 | 1050-1180° C./5-25 minutes | water quenching |
| 3 | 477353 | 40-80 | 1050-1180° C./5-25 minutes | water quenching |
| 4 | 469837 | 40-80 | 1050-1180° C./5-25 minutes | water quenching |
| 5 | 471988 | 40-80 | 1050-1180° C./5-25 minutes | water quenching |
| 6 | 469718 | 40-80 | 1050-1180° C./5-25 minutes | water quenching |
| 7 | 477217 | 40-80 | 1050-1180° C./5-25 minutes | water quenching |
| 8 | 477203 | 40-80 | 1050-1180° C./5-25 minutes | water quenching |
| 9 | 460335 | 40-80 | 1050-1180° C./5-25 minutes | water quenching |
| 10 | 463024 | 40-80 | 1050-1180° C./5-25 minutes | water quenching |

Alloys 1, 7-9 are comparative samples and contain relatively low concentrations of nitrogen. Alloys 2, 3 and 10 are comparative samples and contain comparatively high nitrogen concentrations. Alloys 4-6 are inventive samples which fulfil the requirement 40≤% Ni+100*% N≤50. Alloys 1 and 10 are low in silicon content.

Test samples of each steel heat were prepared. The samples were subjected to creep testing in order to determine their creep properties. Creep testing was performed at two different temperatures: 600° C. and 650° C., by applying a constant stress on each sample and determining the time to rupture and rupture elongation of each sample. Rupture elongation is the length increase until rupture expressed as percentage of nominal length for each sample. The applied stress equals the creep rupture strength of the alloy. The creep rupture strength is defined as the stress which, at a given temperature, will cause a material to rupture in a given time.

The creep tests were performed according to conventional testing methods and conventional mathematic models were used for extrapolating the results.

Figure 2:
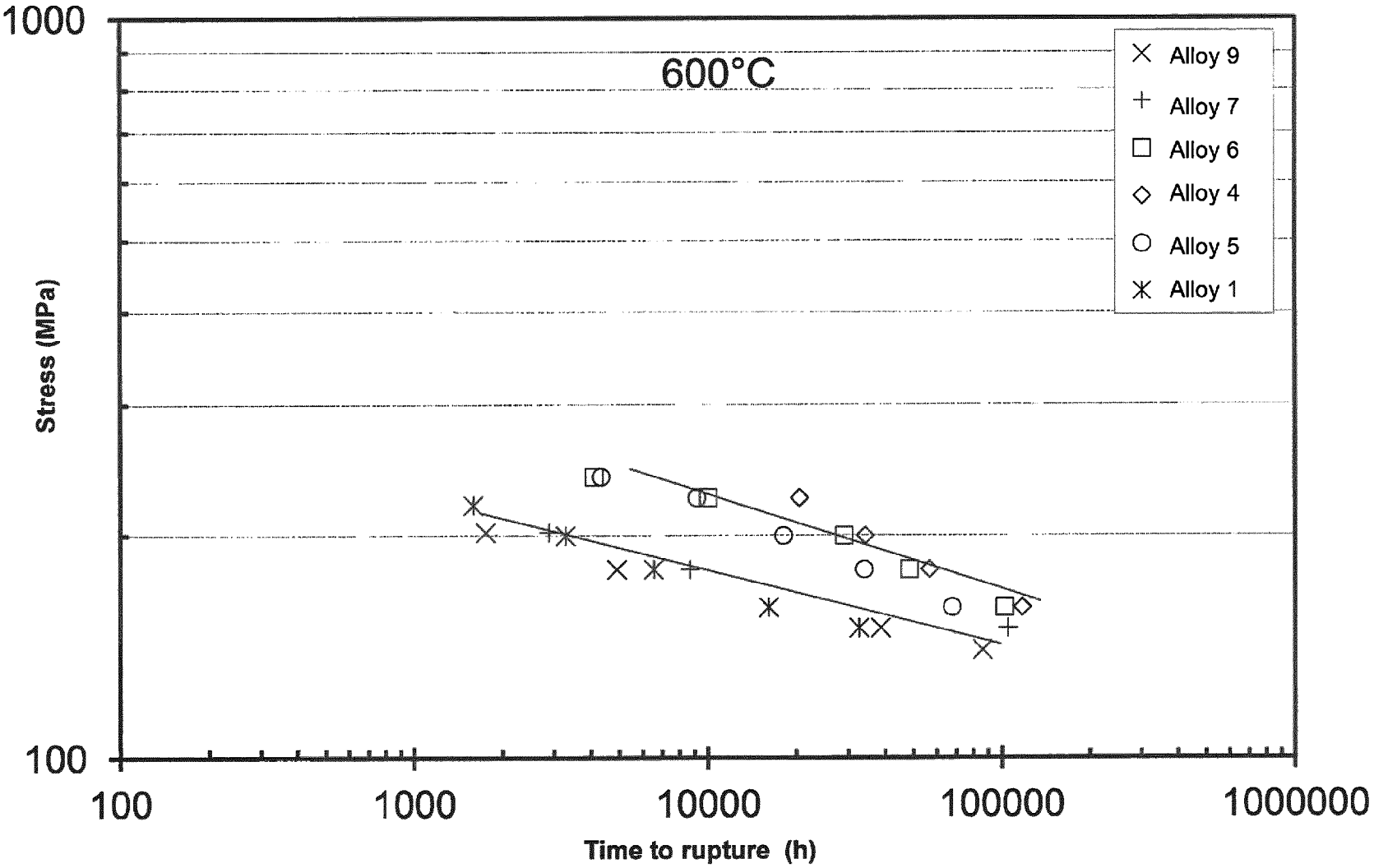
FIG. 2: A diagram showing results from creep tests at 600° C. of inventive alloys and comparative alloys.
Figure 3:
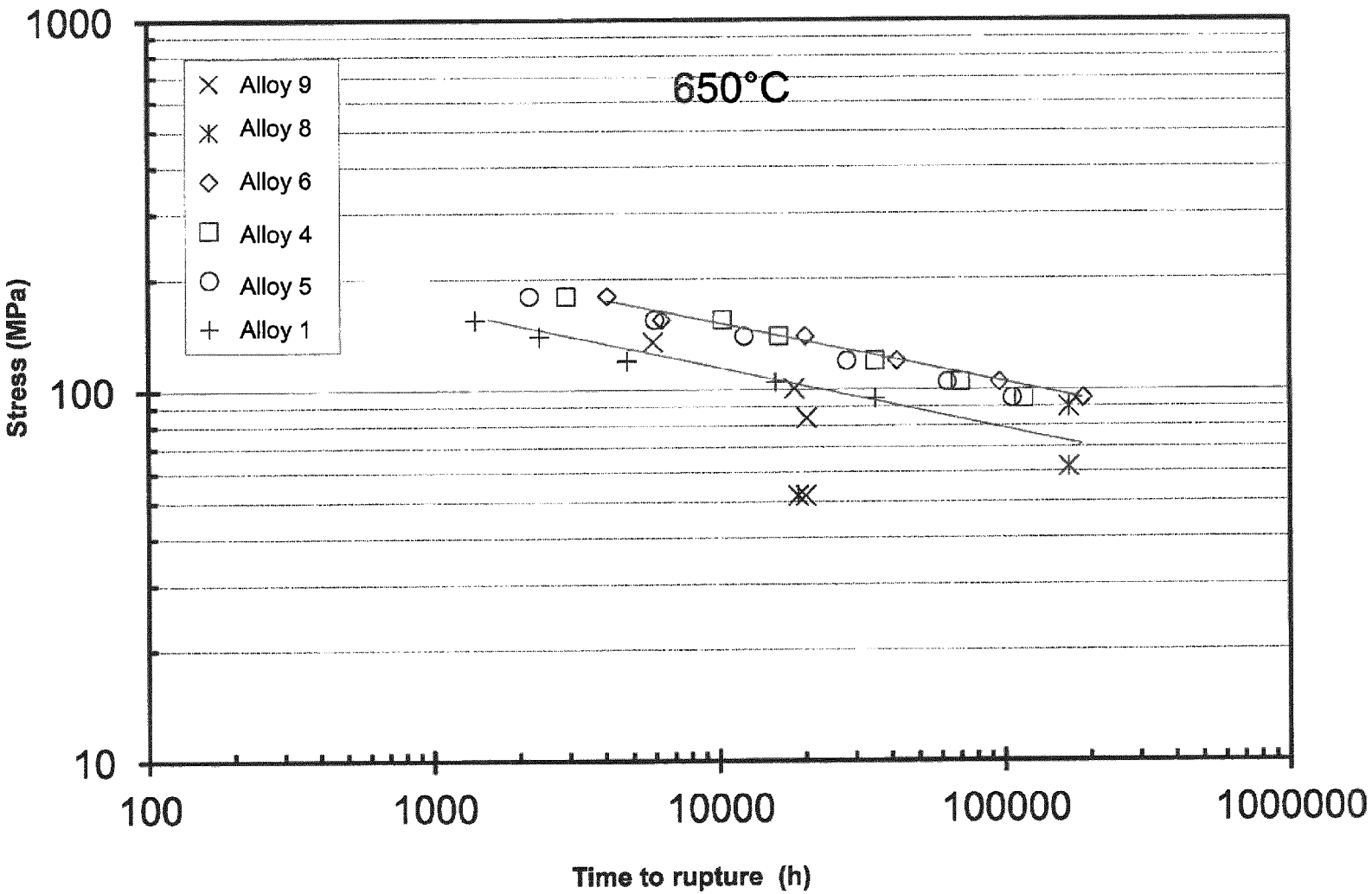
FIG. 3: A diagram showing results from creep tests at 650° C. of inventive alloys and comparative alloys.

FIG. 2 shows the creep strength at 600° C. for inventive alloys 4-6 in comparison to the creep strengths of comparative alloys 1, 7 and 9. FIG. 3 shows the creep strength at 650° C. for inventive alloys 4-6 in comparison to comparative alloys 1, 8, 9. From FIGS. 1 and 2 it is clear that the inventive alloys, for a given creep stress, shows a longer time to rupture than the comparative alloys.

Some other results from the creep testing are shown in tables 2 and 3.

TABLE 2

Creep testing at 600° C.

| Alloy | Heat | Time to rupture (hours) | Stress (MPa) | Rupture elongation (%) |
|---|---|---|---|---|
| 1 | 763554 | 32621 | 150 | 55 |
| 2 | 462269 | 49738 | 170 | 71 |
| 3 | 477353 | 50986 | 170 | 72 |
| 4 | 469837 | 117561 | 160 | 71 |
| 5 | 471988 | 67644 | 160 | 79 |
| 6 | 469718 | 102321 | 160 | 90 |
| 7 | 477217 | 104958 | 150 | 38 |
| 8 | 477203 | 105889 | 150 | 46 |
| 9 | 460335 | 85940 | 140 | 63 |
| 10 | 463024 | 7629 | 165 | 65 |

Table 2 shows the time to rupture and the creep strength or applied stress of each alloy at 600° C. Table 2 further shows the rupture elongation i.e. the length increase until rupture expressed as percentage of nominal length for each sample.

From the test results it can be concluded that the inventive alloys 4-6 shows the highest time to rupture when the magnitude of the creep strength i.e. applied stress is taken into consideration. Alloy 4 shows a peak value of 117561 hours at an applied stress of 160 MPa. Alloys 4-6 further show very high rupture elongation.

The high results on time to rupture in alloys 4-6 are believed to depend on a synergistic effect of addition of both nitrogen and nickel. Addition of nitrogen increases the time to rupture by interstitial solution strengthening and also by precipitation strengthening by the formation of carbonitrides. The dense small carbonitrides that are precipitated in the material effectively block dislocation movement through the grains of the alloy material and hence increase the resistance to deformation. Addition of nickel, and also nitrogen, suppresses the formation of intermetallic phase, such as sigma phase, that affects the ductility negatively and hence improves the ductility of the material. The improved ductility reduces stress concentration, crack initiation and crack propagation. The synergistic effect of these properties results in a very high creep strength.

High ductility, which is expressed as rupture elongation in tables 2 and 3, is further advantageous when the material is used in steam boilers since it allows for high thermoplastic expansion and contraction of the material during start and shutdown of the boiler. Thus, the material can be subjected to cyclic heating and cooling without cracking.

The comparative alloys 1-3, 9 and 10 have comparatively high rupture elongation, see for example comparative alloys 2 and 3 which exhibit a rupture elongation of 71% and 72% respectively. However, theses alloys exhibit a shorter time to rupture, than the inventive alloys. It is believed that the shorter time to rupture in alloys 1-3, 9 and 10 is due to the fact that these alloys contain relatively small amounts of nitrogen. The low nitrogen content results in that fewer carbonitrides are precipitated in these materials than in the inventive alloys. Since alloys 1-3, 9 and 10 comprise few carbonitrides, dislocations can move more easily through these materials. This causes in turn a higher strain rate in the material, i.e. the material deforms faster.

Comparative alloys 7 and 8 exhibits rather high creep resistance, expressed as longer time to rupture at a given applied stress. However, it should be noted that the longer time to rupture for these alloys was determined at a lower stress, i.e. 150 MPa, than the inventive alloys which were evaluated at a stress of 160 MPa. Hence, the time to rupture of the comparative alloys 7 and 8 is lower than the time to rupture of the inventive alloys 4 and 6. The low time to rupture of alloys 7 and 8 is believed to be caused by brittleness induced by intermetallic phase precipitates. As is shown in table 2, alloys 7 and 8 have a rupture elongation of merely 38% and 46% respectively.

Table 3 shows the result of creep testing at some applied loads at a temperature of 650° C.

TABLE 3

Creep testing at 650° C.

| Alloy | Heat | Time to rupture (h) | Stress (MPa) | Rupture elongation (%) |
|---|---|---|---|---|
| 1 | 763554 | 32621 | 95 | 45 |
| 4 | 469837 | 116711 | 95 | 70 |
| 5 | 471988 | 106165 | 95 | 52 |
| 6 | 469718 | 95883 | 105 | 45 |
| 6 | 469718 | 188609 | 95 | 31 |
| 8 | 477203 | 32665 | 120 | 62 |
| 9 | 460335 | 44168 | 105 | 50 |

Table 3 shows that inventive alloys 4-6 have better creep properties expressed as time to rupture, creep strength and rupture elongation than the comparative alloys. The ductility for all alloys, i.e. the rupture elongation is lower at 650° C. in comparison to the ductility at 600° C. The reduction in ductility is caused by the fact that more precipitations are formed at higher temperatures and by faster grain growth at higher temperature.

The invention claimed is:

1. Austenitic alloy comprising in weight %:
C: 0.01-0.015
Si: 0.40-0.52
Mn: 1.7
Cr: 27
Ni: 33
Mo: 3.4
Cu: 0.9-1.0
N: 0.09-0.11
V: 0.07-0.09
the balance being Fe and unavoidable impurities,
wherein the weight % of N and Ni is balanced to fulfill the requirement 40<% Ni+100*% N<45,
wherein a creep test at 600° C. and a stress of 160 MPa exhibits a rupture elongation of 71 to 90% and a time to rupture of at least 100,000 hours,
wherein a creep test at 650° C. and a stress of 95 to 105 MPa exhibits a rupture elongation of 31 to 70% and a time to rupture of at least 95,000 hours, and
wherein the alloy has a microstructure that includes a MX phase.

2. The austenitic alloy according to claim 1, wherein the time to rupture for the creep test at 600° C. and stress of 160 MPa is from 100,000 hours to about 117,500 hours, and wherein the time to rupture for the creep test at 650° C. and stress of 95 to 105 MPa is from 95,000 hours to about 188,000 hours.

3. A component for a combustion plant, the component comprising an austenitic alloy in weight %:
C: 0.01-0.015
Si: 0.40-0.52
Mn: 1.7
Cr: 27
Ni: 33
Mo: 3.4
Cu: 0.9-1.0
N: 0.09-0.11
V: 0.07-0.09
the balance being Fe and unavoidable impurities,
wherein 40<% Ni+100*% N<45, and
wherein a creep test at 600° C. and a stress of 160 MPa exhibits a rupture elongation of 71 to 90% and a time to rupture from about 100,000 hours to about 117,500 hours
wherein a creep test at 650° C. and a stress of 95 to 105 MPa exhibits a rupture elongation of 31 to 70% and a time to rupture of from about 95,000 hours to about 188,000 hours, and
wherein the alloy has a microstructure that includes a MX phase.

4. A component for a combustion plant according to claim 3, wherein said component is a superheater.

5. A component for a combustion plant according to claim 3, wherein said component is a reheater.

6. A component for a combustion plant according to claim 3, wherein said component is an evaporator.

7. Austenitic alloy comprising in weight %:
C: 0.009-0.014
Si: 0.40-0.52
Mn: 1.70-1.73
Cr: 27.11-27.29
Ni: 33.21-33.45
Mo: 3.42-3.44
Cu: 0.95-0.98
N: 0.093-0.11
V: 0.07-0.09
the balance being Fe and unavoidable impurities,
wherein the weight % of N and Ni is balanced to fulfill the requirement 40<%Ni+100*% N<45,
wherein a creep test at 600° C. and a stress of 160 MPa exhibits a rupture elongation of 71 to 90% and a time to rupture from about 100,000 hours to about 117,500 hours,
wherein a creep test at 650° C. and a stress of 95 to 105 MPa exhibits a rupture elongation of 31 to 70% and a time to rupture of from about 95,000 hours to about 188,000 hours, and
wherein the alloy has a microstructure that includes a MX phase.

8. The austenitic alloy according to claim 7, wherein the time to rupture for the creep test at 600° C. and stress of 160 MPa is from 102,321 hours to 117,561 hours, and wherein the time to rupture for the creep test at 650° C. and stress of 95 to 105 MPa is from 95,883 hours to 188,609 hours.

* * * * *